US008939274B1

(12) United States Patent
Ross, Jr. et al.

(10) Patent No.: US 8,939,274 B1
(45) Date of Patent: Jan. 27, 2015

(54) ENVELOPE FEEDER HAVING DUAL ALIGNED CONVEYORS

(71) Applicant: Xante Corporation, Mobile, AL (US)

(72) Inventors: Robert C. Ross, Jr., Fairhope, AL (US); Kenneth Orin Parker, Theodore, AL (US); Joseph Martin deVeer, Mobile, AL (US)

(73) Assignee: Xante Corporation, Mobile, AL (US)

( * ) Notice: Subject to any disclaimer, the term of this patent is extended or adjusted under 35 U.S.C. 154(b) by 0 days.

(21) Appl. No.: 14/155,952

(22) Filed: Jan. 15, 2014

(51) Int. Cl.

| | |
|---|---|
| ***B65G 59/00*** | (2006.01) |
| ***B65H 31/00*** | (2006.01) |
| ***B65G 47/244*** | (2006.01) |
| ***B65G 47/30*** | (2006.01) |

(52) U.S. Cl.
CPC ..... *B65G 47/2445* (2013.01); *B65G 47/30* (2013.01)
USPC ..... 198/461.2; 198/460.3; 198/418.9; 198/419.2; 271/9.09; 271/149; 271/150; 271/157; 414/798.2

(58) Field of Classification Search
USPC ..... 271/2, 9.09, 69, 149, 150, 157, 202, 271/214; 198/407, 460.1, 460.2, 460.3, 198/461.2, 462.2, 418.9, 419.2, 577, 579; 414/798.2
See application file for complete search history.

(56) References Cited

U.S. PATENT DOCUMENTS

| | | | | |
|---|---|---|---|---|
| 2,554,577 A | | 5/1951 | Lauffer | |
| 3,236,162 A | * | 2/1966 | Reist | 198/419.3 |
| 3,562,778 A | * | 2/1971 | Siegel | 71/34 |
| 3,832,823 A | * | 9/1974 | Currie | 53/473 |
| 3,902,712 A | | 9/1975 | Dorer | |
| 4,133,523 A | | 1/1979 | Berthelot | |
| 4,265,443 A | | 5/1981 | Berthelot | |
| 4,348,125 A | | 9/1982 | Fujiwara et al. | |
| 4,522,382 A | | 6/1985 | Chu et al. | |
| 4,524,691 A | | 6/1985 | Miller | |
| 4,603,846 A | | 8/1986 | Miles | |
| 4,618,136 A | * | 10/1986 | Pessina et al. | 271/150 |

(Continued)

FOREIGN PATENT DOCUMENTS

| | | |
|---|---|---|
| EP | 0259650 A2 | 3/1988 |
| EP | 0490686 A1 | 6/1992 |

(Continued)

OTHER PUBLICATIONS

Product data sheet for Straight Shooter Envelope Feeder on sale from Equipment Company, Inc, Columbia, II.

*Primary Examiner* — Douglas Hess
(74) *Attorney, Agent, or Firm* — The Gache Law Firm, P.C.; Russell C. Gache

(57) ABSTRACT

An envelope feeder for a printer having two aligned conveyors moving at different speeds is disclosed. An upstream conveyor moves a backwards slanted procession of envelopes having aligned upper edges onto an inline downstream conveyor that accelerates the envelopes along a curved upper edge so that by the time any single envelope arrives at the printer ingestion or feed slot, the envelope is almost completely flat yet supported upwards slightly so that the pickup roller of the printer can easily and reliably ingest the envelope for processing. Due to the speed of the downstream conveyor, envelopes are continually and reliably presented to the printer to avoid printer stalls. The configuration reduces the amount of skill and operating labor required to establish a high-speed envelope feed source for high-speed printing.

29 Claims, 12 Drawing Sheets

(56) References Cited

U.S. PATENT DOCUMENTS

| | | | | | |
|---|---|---|---|---|---|
| 4,732,262 | A | * | 3/1988 | Labombarde | 271/216 |
| 4,962,844 | A | * | 10/1990 | Francioni | 198/460.3 |
| 5,197,590 | A | * | 3/1993 | Prim et al. | 198/300 |
| 5,356,129 | A | | 10/1994 | Godlewski | |
| 5,417,158 | A | | 5/1995 | Parsio | |
| 5,508,818 | A | * | 4/1996 | Hamma | 358/403 |
| 5,893,701 | A | * | 4/1999 | Pruett | 414/798.2 |
| 5,961,114 | A | * | 10/1999 | Barker et al. | 271/184 |
| 5,967,504 | A | | 10/1999 | Yankloski | |
| 6,050,563 | A | | 4/2000 | Vedoy et al. | |
| 6,105,954 | A | | 8/2000 | Magee et al. | |
| 6,179,280 | B1 | | 1/2001 | Coppolo et al. | |
| 6,688,590 | B2 | | 2/2004 | Billings et al. | |
| 6,817,608 | B2 | * | 11/2004 | Sloan et al. | 271/216 |
| 7,033,129 | B2 | * | 4/2006 | Bigoni | 414/790.8 |
| 7,094,195 | B1 | | 8/2006 | Lindsay | |
| 7,451,972 | B2 | * | 11/2008 | Fukada et al. | 271/9.09 |
| 7,699,303 | B2 | * | 4/2010 | Fairweather et al. | 271/9.08 |
| 7,905,481 | B2 | * | 3/2011 | Kalm | 271/198 |
| 8,181,768 | B2 | | 5/2012 | Kalm | |
| 8,398,076 | B2 | * | 3/2013 | Bernard et al. | 271/216 |
| 8,418,834 | B2 | * | 4/2013 | Sardella | 198/457.02 |
| 2008/0291481 | A1 | | 11/2008 | Haller | |

FOREIGN PATENT DOCUMENTS

| | | | |
|---|---|---|---|
| EP | 0537596 | A2 | 4/1993 |
| EP | 0490686 | B1 | 4/1996 |
| EP | 1013578 | B1 | 11/2002 |
| EP | 1997646 | A2 | 12/2008 |
| EP | 2030923 | A2 | 4/2009 |
| EP | 2213602 | B1 | 11/2012 |

* cited by examiner

ENVELOPE FEEDER HAVING DUAL ALIGNED CONVEYORS

FIELD OF THE INVENTION

The present invention relates generally to sheet feeder mechanisms for electrographic printing machines. In greater particularity, the present invention relates to the use of conveyors to feed paper media into a printing machine. In even greater particularity, the present invention relates to conveyor based envelope feeders for laser or inkjet printers.

BACKGROUND OF THE INVENTION

Envelope feeders are typically used by organizations such as banks or insurance companies, print shops, and mailing houses that service such organizations, to produce a large volume of mail pieces. For example, banks send out monthly balance ledgers, insurance companies send out claim summaries, and for corporations shareholders might receive quarterly income/dividend statements. Each envelope must be labeled in order to properly utilize the U.S. Postal System, and each must meet certain USPS printing positional requirements. While in the past "windowed" envelopes were utilized in order that preprinted envelopes might be combined with individually printed sheets of paper oriented to show through the envelope window, most modern mail printing systems include the ability to individually print envelopes using on-site, relatively inexpensive laser or inkjet printers. This allows for the combining of customized envelopes with customized printed sheets at the point of disembarkation.

However, the feeding of envelopes into relatively inexpensive commercial laser or inkjet printers can be problematic. The typical configuration is to have an "envelope stacker" or "envelope shoe" holding dozens or even hundreds of envelopes in a stacked column from which individual envelopes are pulled from the bottom of the stack and conveyed along a conveyor deck that is positioned to feed envelopes into the manual feed tray of a printer. A pair of friction rollers commonly referred to as "footballs" presses down upon a leading edge of an envelope held in the stacker and in conjunction with a pair of conveyor rolling belts engages the envelope to sheer it away from the bottom of the envelope stack. The footballs include removable donut weights on a spindle that extends upward from the feed deck so that the pressure of the footballs may be adjusted in response to envelope size and thickness, and other conditions. Alternatively, the footballs are biased downwards with a spring which may be adjusted with a tensioning knob or screw. The sheered envelope then moves forward under the weight of additional passive rollers on the conveying rollers to keep consistent friction between each envelope and the conveyor so that the envelopes maintain edge alignment relative to a receiving input or ingestion area on a printer, such as a manual input tray.

However, these "stacker" based envelope feeders are operator intensive because a myriad of elements require continuing adjustment and attention by an operator. First, the footballs must be made with a consistent friction coefficient and, hence, the material diopter must be closely monitored during manufacturing. Second, the weight of envelopes changes with the envelope stack height and consistent sheering of envelopes can typically be maintained only for a certain range of envelope stack height which may vary with each new batch of envelopes. In addition, adjustments to the side walls and backstop retaining wall in the envelope stacker must be adjusted for a particular weight and size of envelope. Finally, as conveyor belt friction varies with time, and due to variations in humidity, dust, and other environmental factors, football weight, position of the footballs relative to the leading edge of an envelope, and the backstop wall angle must be adjusted frequently in order to provide a consistent feeding of envelopes into the input tray or slot of a printer. Hence, an operator must become accustomed to each feeder and skilled at making minute adjustments to the feeder elements to keep a consistent flow of envelopes into a printer.

The issue affects more than just print job speed completion. Modern laser printers are designed for high printing speeds and the processing of large batches of stock media. Often such systems apply toner images to a transfer belt and roller in anticipation of receiving a fast moving group of media sheets. Printers have sensors at their source input channels and if a few envelopes are processed and then the next expected envelope does not appear in an expected time interval a "stall" condition occurs within the printer and the transfer belt and roller may need to be cleaned and reprocessed in order to prepare for the arrival of a new batch of envelopes. Hence, great amounts of toner may be wasted and the life expectance of a printer's transfer roller may also be decreased. The problem is exacerbated in color laser printers.

Hence, what is needed is an envelope feeder that will work with relatively inexpensive inkjet or laser printers and keep those printers continuously fed or "primed" with envelopes without stalls, and without the constant and continuous operator attention required by conventional envelope feeders.

SUMMARY OF THE INVENTION

The invention is an envelope feeder for a printer having two aligned conveyors moving at different speeds. An upstream conveyor moves a backwards slanted procession of envelopes having equal height upper edges onto a downstream conveyor that accelerates the envelopes along a curved upper edge so that by the time any single envelope arrives at the printer ingestion or feed slot, the envelope is almost completely flat yet supported upwards slightly so that the pickup roller of the printer can easily and reliably ingest the envelope for processing. The conveyors create a stack of envelopes at a pickup assembly in the input slot of the printer and a sensor is positioned at the pickup assembly so that when the stack of envelopes is sufficiently depleted, a signal is sent to a control assembly in the feeder to advance the conveyors for a set duration, thereby replenishing the envelope stack at the printer. The entire feeder is a movable, self-contained unit that may be mated to varying types of high-speed printers.

Other features and objects and advantages of the present invention will become apparent from a reading of the following description as well as a study of the appended drawings.

BRIEF DESCRIPTION OF THE DRAWINGS

A envelope feeder incorporating the features of the invention is depicted in the attached drawings which form a portion of the disclosure and wherein.

DESCRIPTION OF THE PREFERRED EMBODIMENTS

Figure 1:
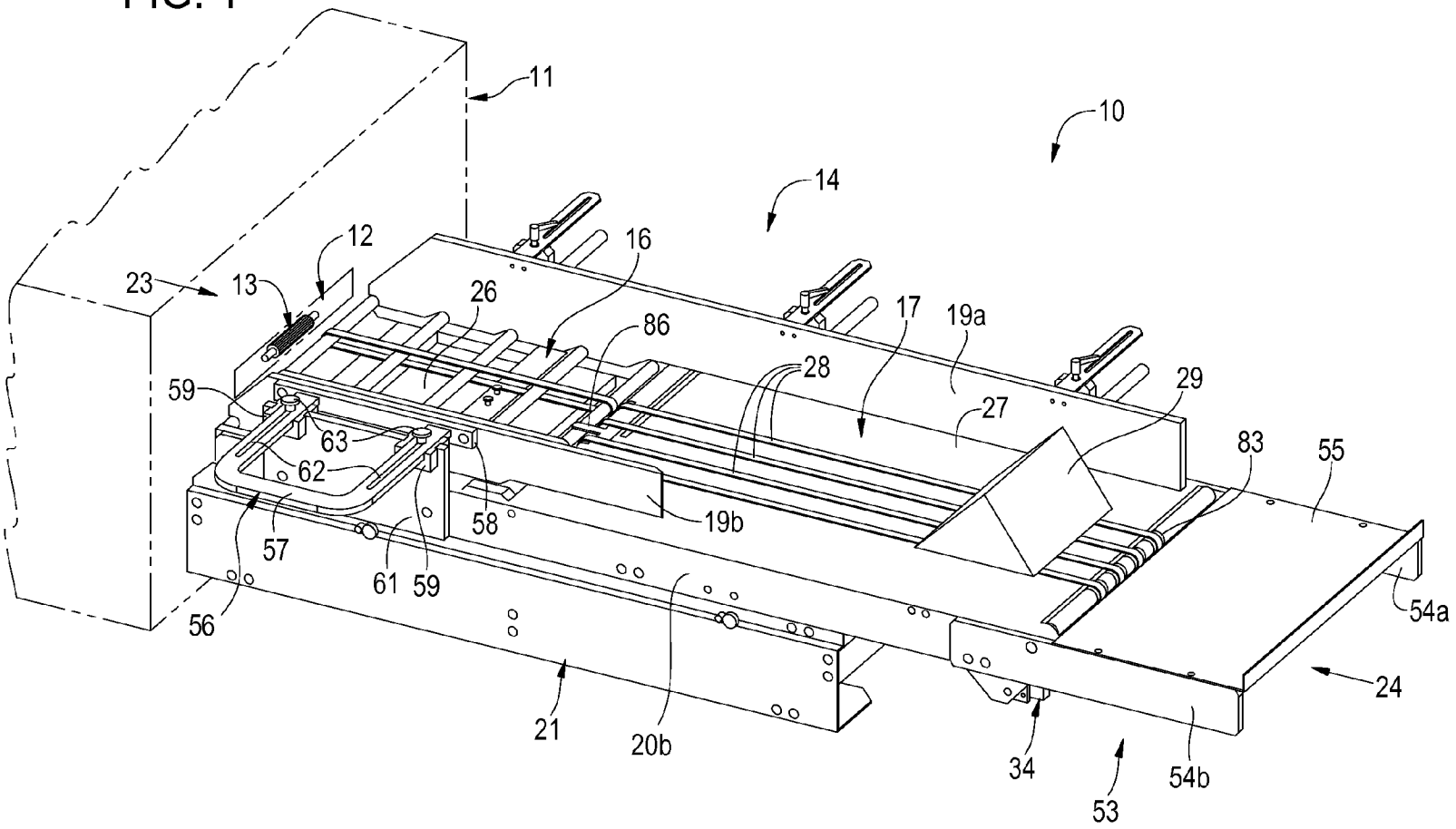
FIG. 1 a top perspective view of the envelope feeder.

Referring to the drawings for a better understanding of the function and structure of the invention, FIGS. 1-5 show the envelope feeder 10 from different views showing all of the major components of the invention. A printer 11 is shown in phantom having the invention positioned so that the output of the feeder 10 inserts envelopes into the input tray or input slot 12 of printer 11. The feeder 10 includes a horizontal feeder assembly 14 that supports an acceleration conveyor assembly 16 and a feed conveyor assembly 17. Both the acceleration conveyor assembly 16 and feed assembly 17 are laterally supported by guide plates 19*a,b* and side plates 20*a,b*, and the entire assembly 14 is slidably supported below by a base 21.

As shown, the acceleration conveyor 16 is positioned toward the downstream end 23 of the feeder 10, and the feed conveyor 17 is positioned toward the upstream end 24 of the feeder 10. The acceleration conveyor assembly 16 is positioned over a cover 26 that is also laterally supported by the guide plates 19*a,b*. The feed conveyor assembly 17 includes a deck 27 over which four (4) belts 28 traverse for movement of envelopes as will be discussed. A triangular backstop 29 is positioned along the length of the conveyor feed assembly 17 to provide a support to a stack of envelopes loaded onto the deck 27. The position of the backstop is determined by the amount of envelopes loaded onto the conveyor feed assembly deck 27. As seen, the left guide plate 19*b* is somewhat shorter than the right guide plate 19*a* to facilitate operative access to the upstream portion of the deck 27 and for the loading and unloading of envelopes against the backstop 29.

Figure 2:
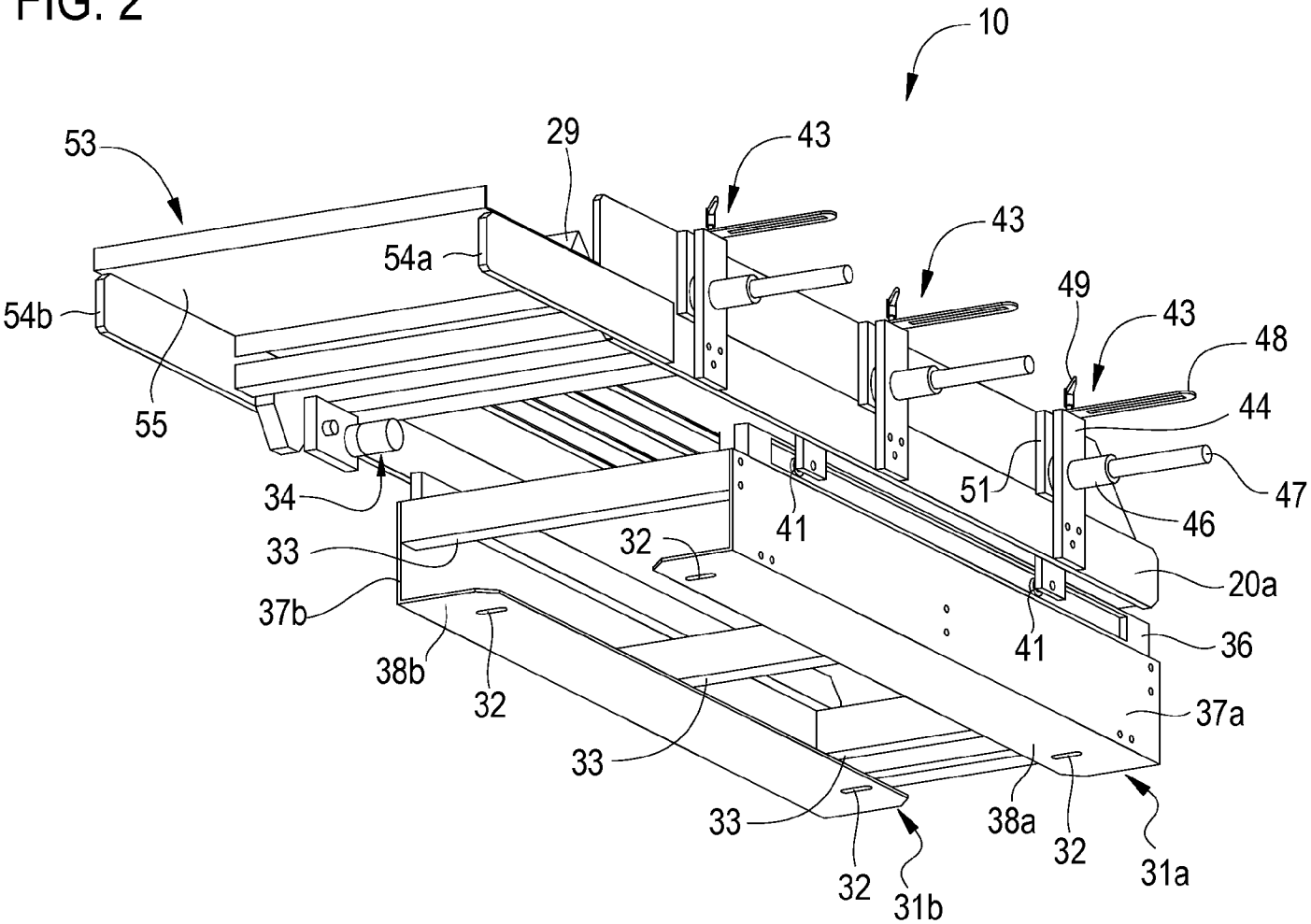
FIG. 2 is a bottom perspective view of the envelope feeder.
Figure 3A:
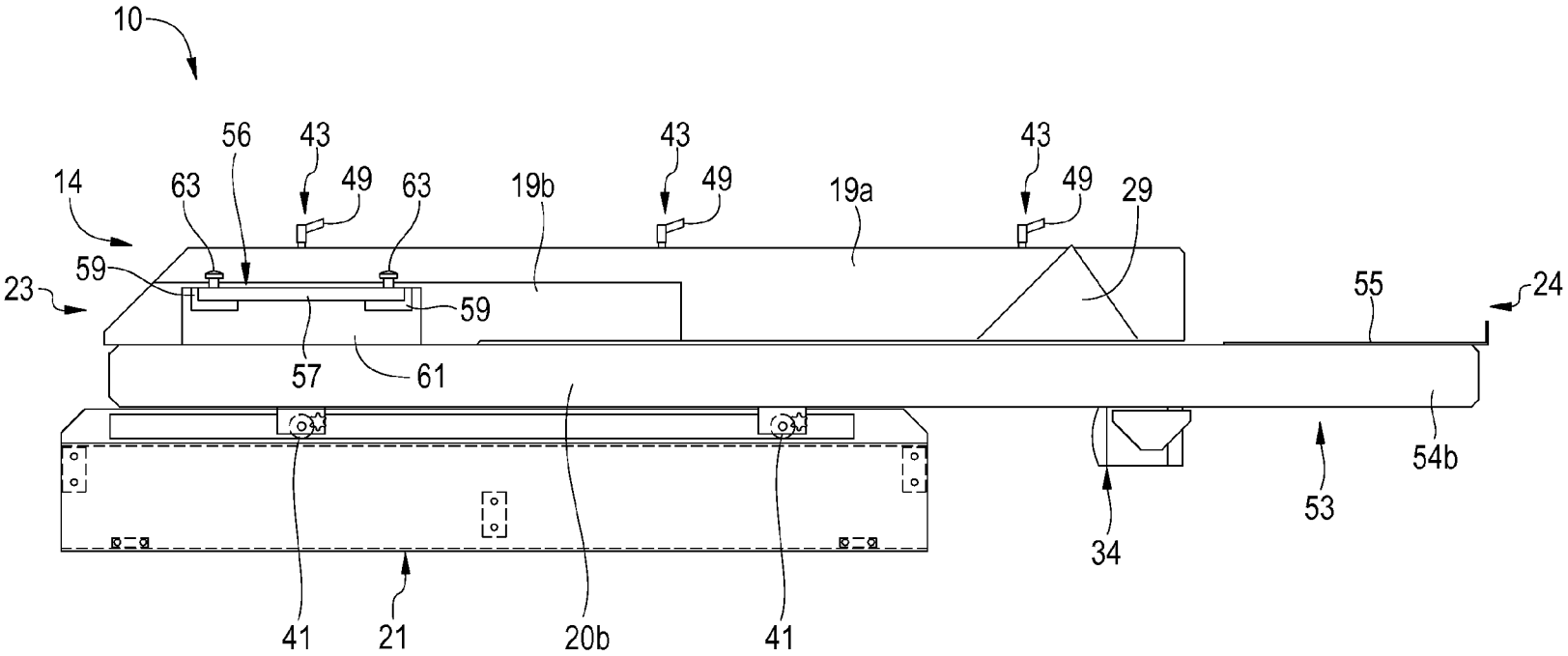
FIG. 3A is a left side elevational view of the envelope feeder.
Figure 3B:
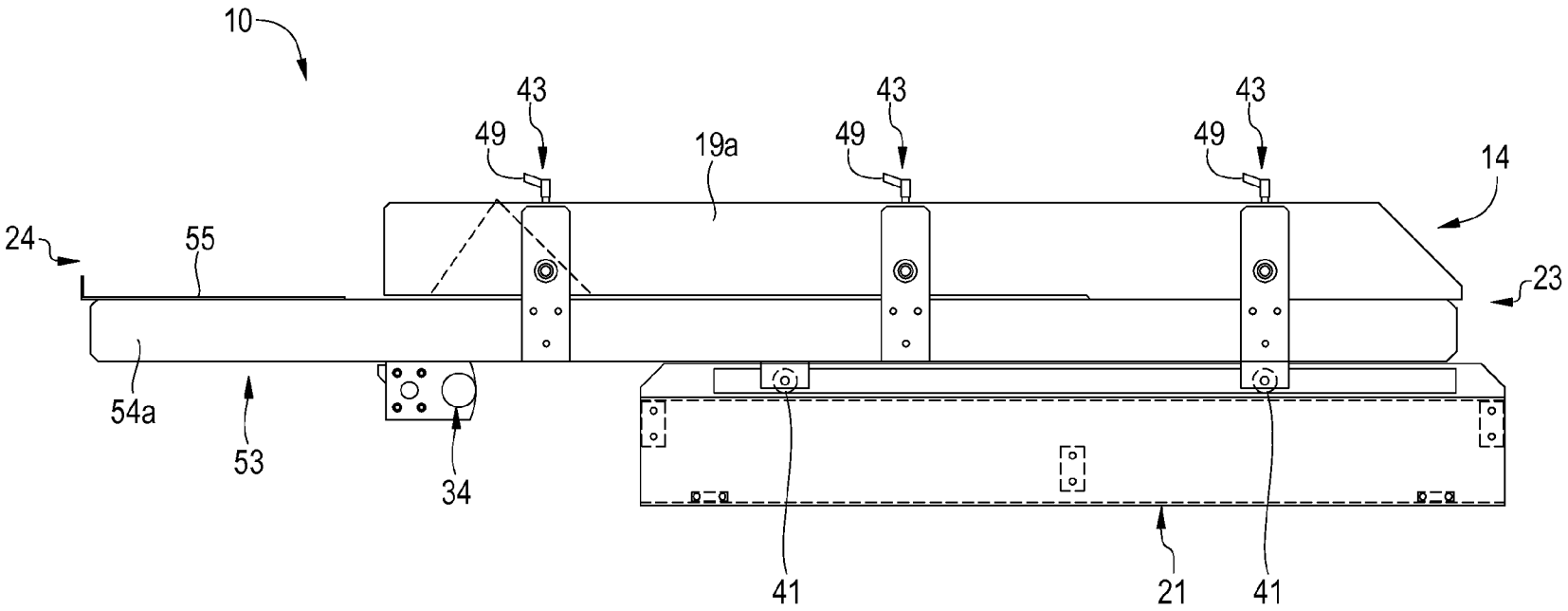
FIG. 3B is a right side elevational view of the envelope feeder.

FIG. 2 shows the underside of the feeder 10 and provides a better view of how the horizontal feed assembly 14 slides relative to the printer. The base 21 includes two slide panels 31*a,b*, each having a vertical portion 37*a,b* and an angled horizontal portion 38*a,b*. Each horizontal portion 38 includes mounting holes 32 for mounting the base 21 on a work table or other suitable platform (see FIG. 6) for the feeder 10. The work table typically might be mounted on lockable wheels so that the entire feeder 10 might be moved into a general relative position next to printer 11 to which the feeder 10 would be mated. The slide panels 31*a,b* are connected together by three struts 32 that stabilize the base 21 so that as the horizontal assembly 14 is moved toward or away from the printer 12 the slide panels 31 will not buckle. A pair of slide rails 36 is affixed to the top edge of each slide panel 31 and the horizontal feed assembly 14 includes two pairs of rollers 41 bolted onto its lower side edges sized so that they lock into rails 36. The arrangement allows for the horizontal feed assembly 14 to be finely positioned toward the printer after the work table on which the feeder 10 rests has been positioned within the general vicinity of the printer 11, thus facilitating mating.

A series of guide mount assemblies 43 laterally support the right guide plate 19*a* so that it may be moved inward and outward relative to the acceleration conveyor assembly 16 and the conveyor feed assembly 17 to accommodate different lengths of envelopes. A linear guide mount plate 44 is bolted to the right support plate 20*a* and a hollow sleeve 46 is mounted on the inside surface of the guide mount plate 44. A guide mounting plate 51 is bolted to the outside surface of the guide plate 19*a* and a shaft 47 affixed to the plate 19*a* such that the shaft extends laterally away from the guide plate 19*a*. The shaft 47 extends through the hollow sleeve 46 so that the guide plate 19*a* is supported by the shaft as it translates through the sleeve 46. A guide locking plate 48 is affixed to the top of the guide mounting plate 51 which has a channel formed in the center of the plate. A locking handle 49 is screwed into the top of mount plate 44 and extends through the locking plate channel such that when the handle 49 is tightened movement of the locking plate 51 is arrested, thereby locking the guide plate 19*a* in place at a selected position along the locking channel. The three guide mount assemblies 43 are identical and provide lateral, adjustable support for moving the right guide plate 19*a* in and out from the envelope flow area.

On the left side of the feeder 10, generally the side from where an operator controls the feeder 10, the left guide 19*b* is laterally adjusted with a "C" shaped guide handle 57 that is part of a left guide mount assembly. The handle 57 is mounted to the guide plate 19*b* with a plate 58 bolted to the guide plate. The arms of the handle 57 extend through two guide blocks 59 that are affixed to the top of another mounting plate 61 that is bolted to the left support plate 20*b* at its lower end. The arms of the handle 57 include slots or channels 62 on each arm and a pair of locking bolts 63 extend through each channel screw into the blocks 59. The blocks 59 are formed such that the handle 57 may be moved inward and outward to effect lateral movement of the left guide 19*b* and then locked into place by tightening the bolts 63.

Figure 4A:
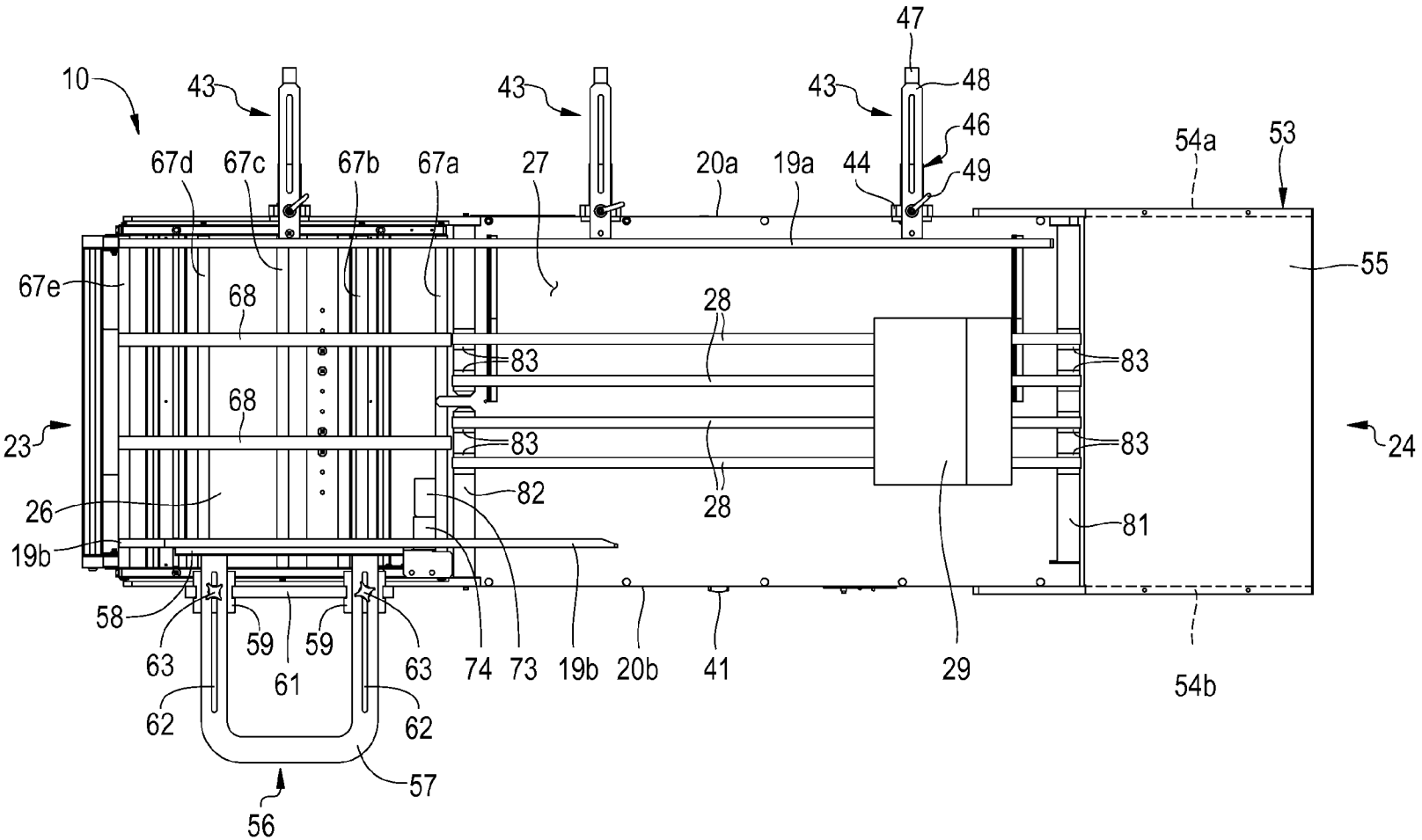
FIG. 4A is a top plan view of the envelope feeder.
Figure 4B:
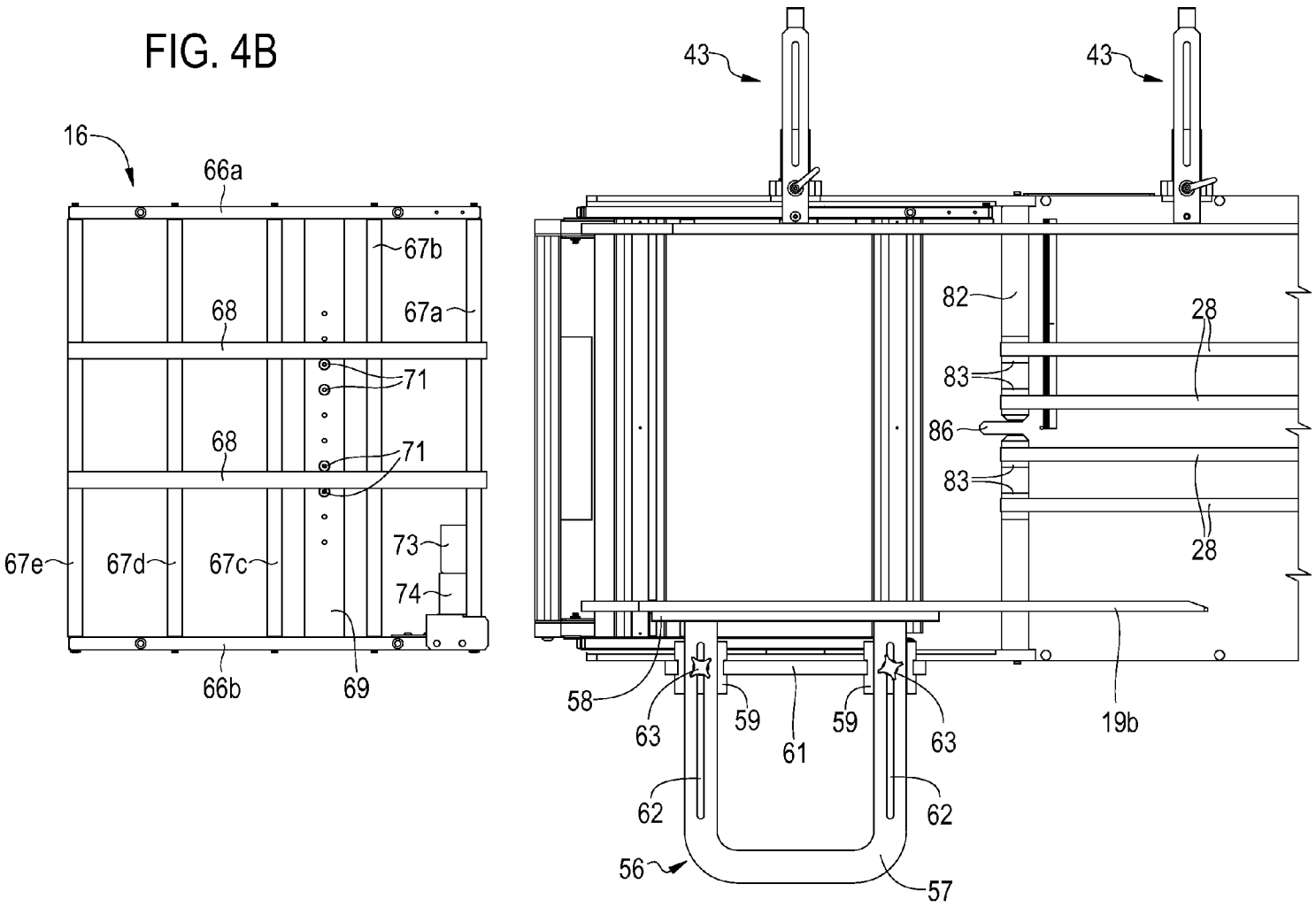
FIG. 4B is a magnified top plan view of the envelope feeder with the acceleration conveyor assembly removed from the horizontal feed assembly and positioned to the left.

Referring now to FIG. 4A and FIG. 4B, the feeder includes an acceleration conveying assembly 16. For illustration purposes in FIG. 4B, the acceleration conveyor assembly 16 has been exploded from its normal position within in the horizontal feeder assembly 14 shown in FIG. 4A. The acceleration conveyor assembly 16 includes a pair of bearing mount members 66*a,b* that rotatably support five (5) shafts spanning the distance between the mounts 66*a,b*. Two rubber conveying belts 68 surround the shafts 67 from the right-most shaft to the left-most shaft. A belt separator bracket 69 spans the two bearing mount members 66*a,b* and provides additional support between the pair of bearing mount members 66*a,b*. The belt separator bracket 69 also includes a plurality of guide screws 71 that extend upwards from the bracket 69 to guide the lower belt portion during travel around the shafts 67.

The right-most shaft 67*a* includes a drive motor 73 and gearing assembly 74 that turns shaft 67*a* via a short drive belt (not shown) at the left most extent of the shafted 67*a* to power belts 68. Due to the elastic tension that the belts 68 exert on the shafts 67, when shaft 67*a* rotates, the other shafts passively rotate in response thereof.

Figure 5:
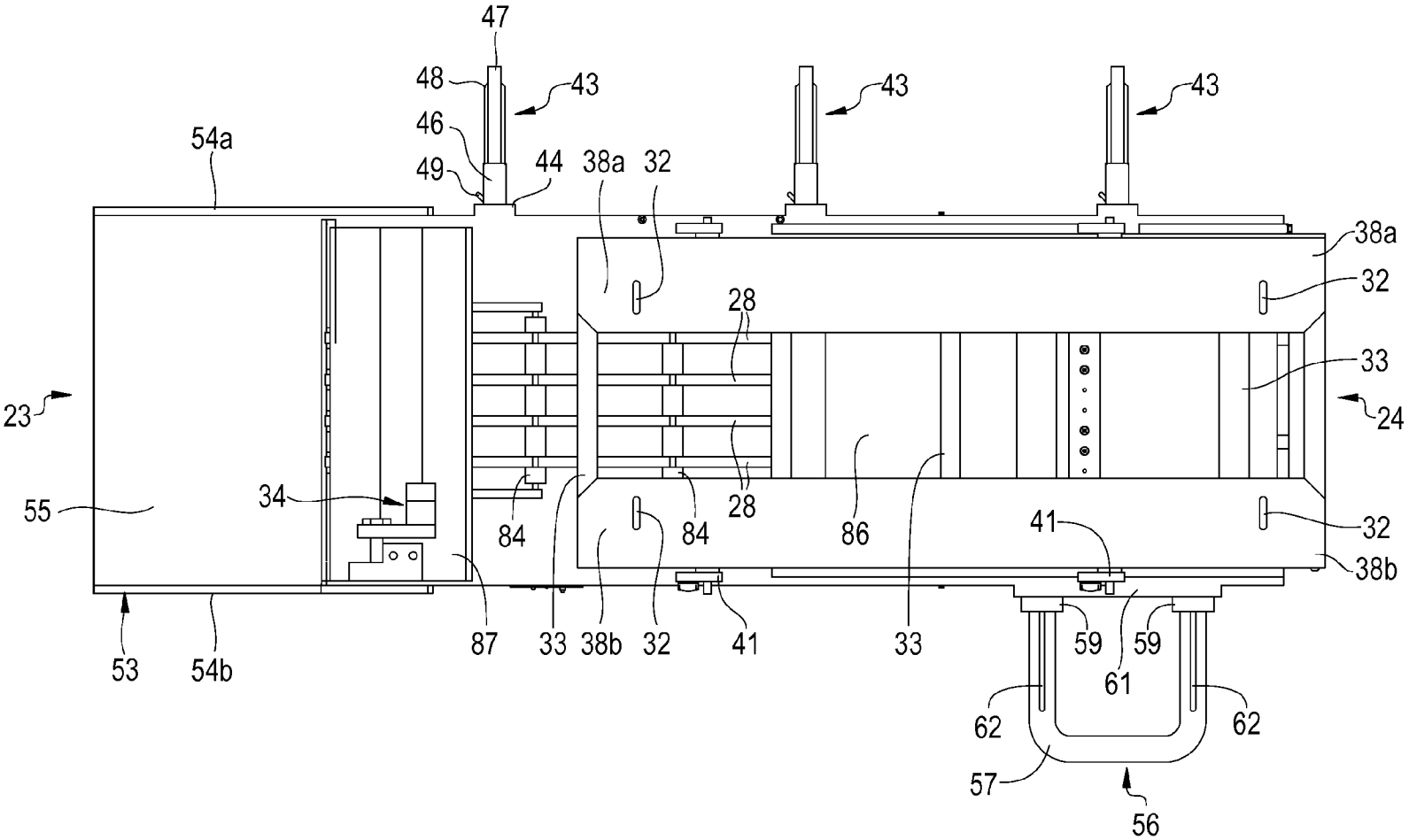
FIG. 5 is a bottom plan view of the envelope feeder.

Referring also to FIG. 5, it may be seen that envelope feed conveyor assembly 17 includes a motor drive assembly 34 connected to a drive shaft 81 positioned between a upstream preparation deck 55 and loading deck 27. The drive assembly 34 includes a gearing assembly next to a standard electric drive motor that drives a gear positioned on the metal shaft of the shaft 81. A similar passive idler shaft 82 is positioned on the other end of deck 27 toward the downstream end 23. Each shaft 81,82 includes four recessed belt engagement portions 83 having raised surface features to increase friction. Each recessed portion 83 on roller 81 has an aligned companion recessed portion, and four belts 28 span the two rollers at each recessed portion 83 as shown. The belts are made of plastic fabric, and while resilient their surface features are such that the underside surface glides easily over the top of loading deck 27 while being supported by same.

Underneath loading deck 27, a series of roller belt guides 84 that are rotatably supported at their ends by brackets (not shown) affixed to the underside of deck 27 and interior surfaces of the support plates 20*a,b*. The brackets are formed such that they are adjustably spaced from the underside of the deck 27 to impart a selected amount of tension to each belt 28 toward the underside surface of deck 27. Also, each belt guide 84 includes a plurality of spacers affixed to the primary shaft of the belt guide to separate each belt 28 from one another and maintain a preselected spatial relationship between them. Typically, three guides 84 are utilized underneath deck 27 spaced at equal distances from each other and from the end rollers 81 and 82.

At the downstream end, deck 27 includes at least one guide finger 86 extending toward the downstream direction and over roller 82 so that envelopes moving in the downstream direction do not fall in between rollers 82 and 67*a* during movement toward printer 11. Envelope feed conveyor 17 also includes an underside cover 86 covering most of the underside of deck 27 and the belts 28, and a second cover 87 covering the feeder drive shaft 81 and, generally, the belts 28 in upstream end of the envelope feeder 17.

For holding envelope boxes and related envelope container paraphernalia, the feeder 10 includes a preparation deck assembly 53 that is supported by two rail plates 54*a,b* having their ends bolted to the upstream extent of the right support plate 20*a*. The plates 54*a,b* are of sufficient thickness so that relatively heavy envelope boxes may be placed on the deck 55 such that the operator may have an ample supply of envelopes for each job. In order to avoid tipping of the feeder due to boxes of envelopes laid on the preparation deck 55, the base 21 includes mounting apertures 32 in the lower portions of the slide panels 31*a,b* which preferably are used to firmly mount the base on a work table (see FIG. 6).

Figure 6:
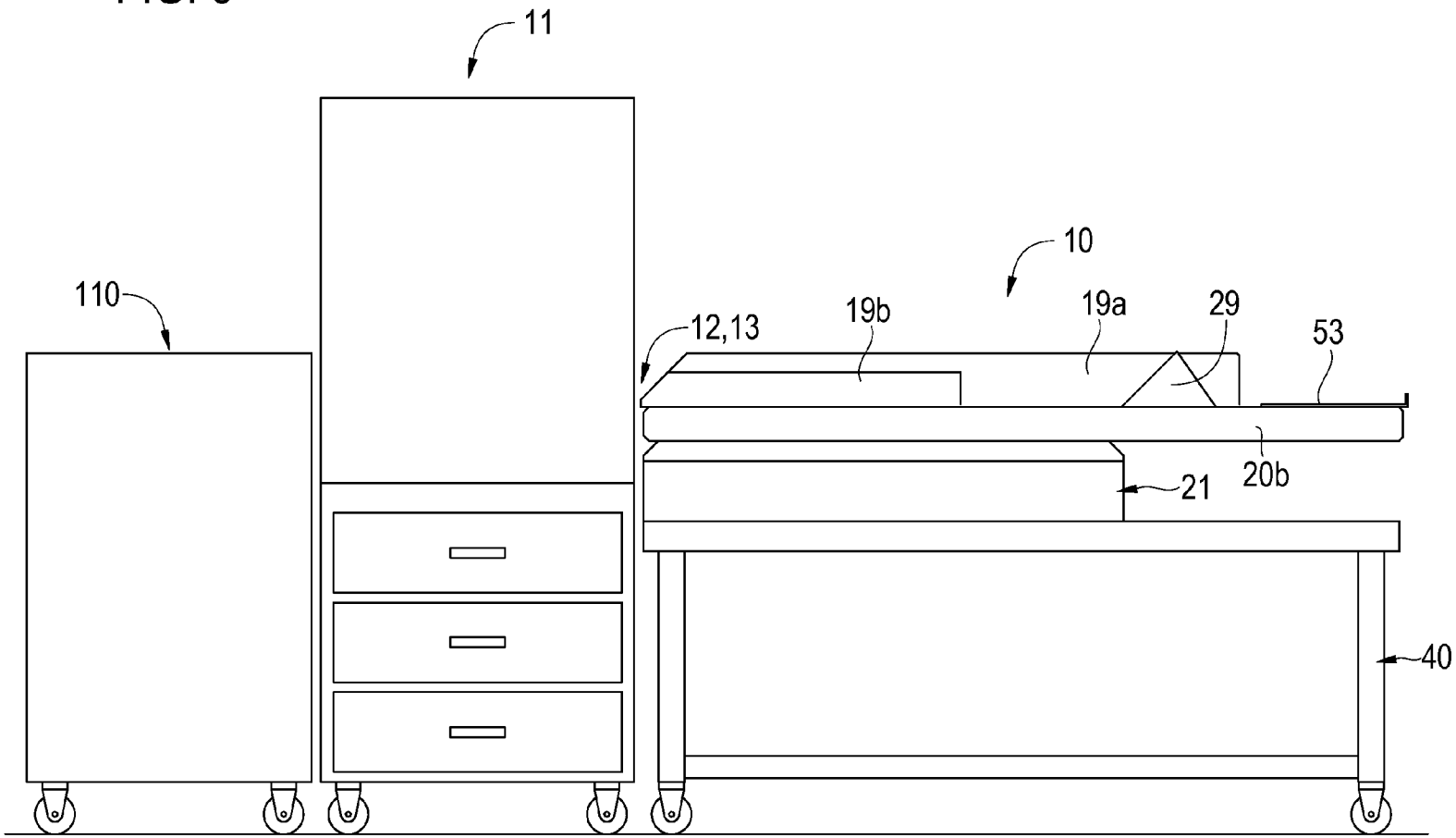
FIG. 6 is a diagrammatic view of the envelope feeder connected to a printer.

As may be seen in FIG. 6, the feeder 10 is preferably bolted securely onto a table 40 and moved into a position adjacent to the printer 11 with collator 110 abutting the manual input ingestion 12 area on the printer so that the downstream end 23 of the feeder 10 abuts the pickup roller assembly 13 on the printer 11. The horizontal feeder assembly 14 may also be finely adjusted using the horizontal feed assembly rollers 41 so that roller 67*e* discharges envelopes directly into the pickup roller assembly 13 across a gap between roller 67*e* and pickup roller 18 (see FIG. 7). As may be understood, the gap between the feeder 10 and the printer 11 may be adjusted to suit the type of printer to which the feeder 10 is being mated and the type of envelope media being printed.

Figure 7:
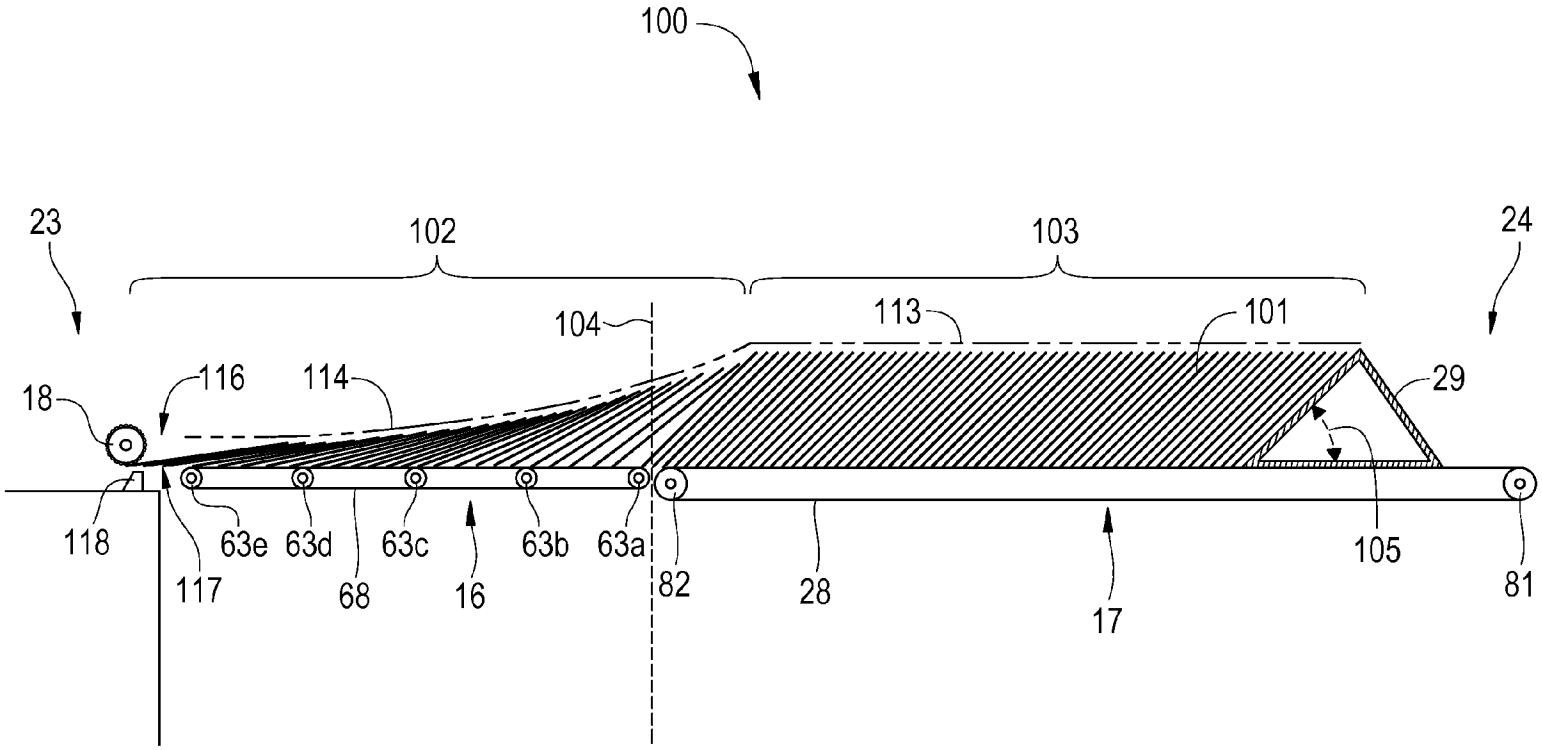
FIG. 7 is a diagrammatic view of the envelope feeder showing the relative positions of envelopes with respect to the conveyors during operation.

Referring now to FIG. 7, it may be seen that the envelope feeder 10 is designed to provide a two stage feed flow 100 that suits the ingestion of envelopes for printing at a rate adapted to suit most high-speed printers. Conveyors 16 and 17 are oriented longitudinally and in the same horizontal plane to create a continuous smooth liner movement of envelopes 101 along the feeder 10 from an upstream end 24 toward a downstream end 23. Preferably, envelopes 101 are stacked against backstop 29 at approximately a sixty (60) degree backward slanting angle 105 and laid in a grouped parallel fashion 103 on the feed conveyor belts 28 such that the backward angle is maintained, thereby creating a horizontal plane 113 along the upper edges of the envelopes 101 parallel to the loading deck 27. Other backward facing angles will work also, however, the inventors have found about sixty (60) degrees to be optimal. When actuated, the conveyors 16 and 17 operate at different speeds with the accelerator feed conveyor 17 moving at approximately eight (8) times that of feed conveyor 17. Movement is coordinated with a microprocessor (see FIG. 9) so that conveyors 16 and 17 move simultaneously. However, since the acceleration conveyor 16 is moving faster than the feed conveyor the lower edge of each envelope 101 advances more rapidly as soon as an envelope reaches the separation point 104 (a slight gap) between each conveyor. As the lower edges of the envelopes advance toward the downstream end 23, the lower edges of each envelope spread out relative to any adjacent envelope moving along the acceleration feed conveyor 16, thereby creating a shingled feed grouping of envelopes 102 that form a curve 114 along their upper edges as shown. In three dimensions, the curve 114 is actually a curved plane formed along the upper edges of the envelopes. The severity of the curve angle 114 will vary depending upon the height of the particular envelope being fed along the conveyors, the speed of the acceleration feed conveyor, and the length of the acceleration feed conveyor 16. But, generally the curve 114 will have a downward slope that is most severe from the gap 104 to about the mid-way point of the acceleration feed conveyor toward the downstream end, with a more moderate curve slope within the second half of the acceleration feed conveyor.

The shingled envelope group 102 terminates at the downstream end of the acceleration feed conveyor with an envelope pickup stack 117 in an engagement/pickup zone 116 of pickup assembly 13. As the envelopes move toward the printer pickup roller assembly 13 a stack of envelopes forms below a pickup roller 18, being partially supported and moved into place by roller 67*e*, at which point the overlap of each envelope over one another increases considerably. The stack height is typically at least 6 envelopes deep which raises the upper most envelope to easy engagement with the pickup roller 18 and facilitates the ingestion of envelopes into the printer 11 at a speed suitable for high-speed printer processing. Since the acceleration feed conveyor is continuously moving envelopes into place at the bottom of the envelope stack 117, the stack 117 is continuously replenished at a rate that will sustain the availability of an envelope to the pickup roller 18 at all times until all envelopes on the acceleration feed conveyor are consumed. A sensor 118 is positioned below the envelope stack 117 in the pickup zone 116 and is configured to deflect backward and downward at the presence of any envelopes within the pickup zone 116. When the pickup zone 116 is absent of envelopes, the sensor 118 moves upward and provides a signal to indicate a "paper-out" condition to the printer 11, or to the feeder 10 if desired and as will be further discussed.

Figure 8:
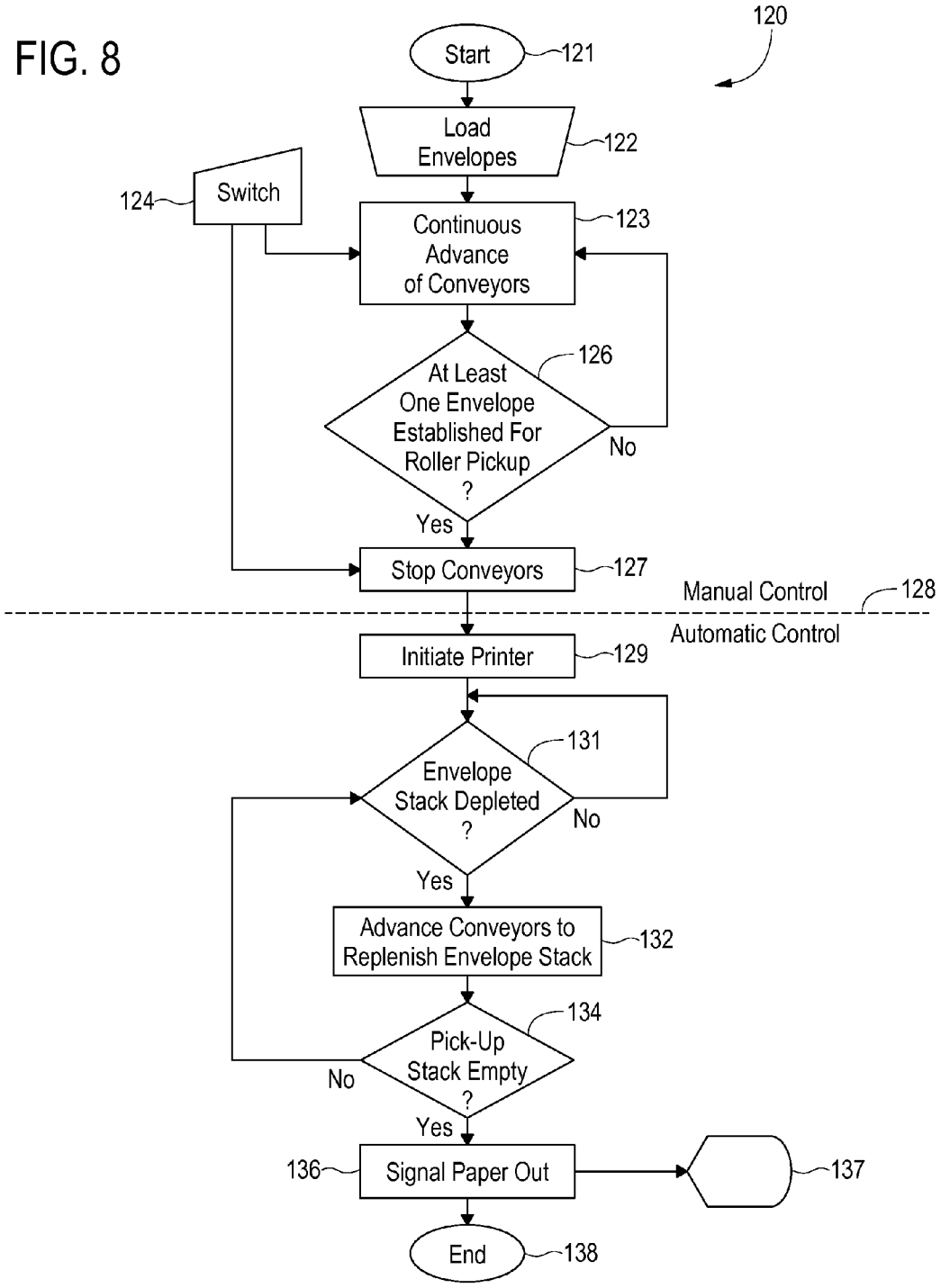
FIG. 8 is a movement flow diagram of the envelope feeder.

Referring to FIG. 8 in view of FIG. 7, it may be seen that the process 120 of feeding envelopes utilizing feeder 10 involves a combination of operator and automatic controls 128. An operator loads a stacked collection of envelopes against the backstop 122 and initiates a continuous advancement of the acceleration and feed conveyors (16 and 17) 123 utilizing a switch 124 until a satisfactory envelope pickup stack 117 has been established 126. Although a stack of about six (6) envelopes is preferred, as long as one envelope is present in the pickup zone the automatic feeding process will proceed successfully under automatic control. Once envelopes are available for the printer 11 to process in the pickup zone 116, the conveyors are switched off 127 and the printer 11 initiated 129. As part of the pickup assembly 13, an optical proximity sensor (153 in FIGS. 9 and 10) detects the travel distance of the pickup roller 18 as it moves down to pick up an envelope by detecting a reflective surface (163 in FIG. 10) on the roller 18. As the envelope pickup stack 117 depth diminishes due to printer ingestion, the travel distance of the pickup roller must increase to pickup remaining envelopes. The sensor 153 is calibrated to detect a certain length of movement of the pickup roller 18 downward corresponding with a depletion of the envelope stack to a known quantity of envelopes, typically less than or equal to 6 envelopes. When the sensor 153 is triggered, it sends a signal 131 to a control system 140 (see FIG. 9). The control system 140 responds by advancing both conveyors for about one half (½) a second 132 causing several envelopes (typically 4-6) within the shingled envelope group 102 to advance into the envelope stack 117 at the bottom-most position of the stack. As can be understood by steps 131, 132, and 134, the acceleration feed conveyor 16 will continue to feed envelopes into the envelope stack for consumption by the pickup roller 18 as long as envelopes are present within the stack 117 responsive to continuing pickup roller sensor signals. While the inventors have found that one half (½) a second of conveyor advancement is satisfactory for standard, low-cost electric drive motors, the period of time for advancing the conveyors in coordinated unison will depend upon the envelope ingestion speed (i.e. the print speed of the printer) and the movement speed of the conveyors 16,17. However, once the conveyor activation time duration has been satisfactorily established, the conveyors will be continually advance envelopes at coordinated intervals to replenish the envelope stack 117 irrespective of the speed at which the envelopes arrive at the pickup zone 116, and irrespective of how long or the type of envelope media that has been loaded onto the conveyors. Moreover, such replenishment is done without operator intervention.

When no further envelopes are present in the stack 117, the paper out sensor 118 will rotate upwards and send a signal 136 to indicate on a display 137 that a paper-out condition has occurred. The signal can be processed internally by the printer pursuant to known processing within the printer electronics when paper is unavailable, and/or the signal can simultaneously be processed by the control system 140 to stop the conveyors 16 and 17 from further movement. Alternatively, an operator can simply actuate a switch on the feeder 10 to disengage further movement of the conveyors.

Figure 9:
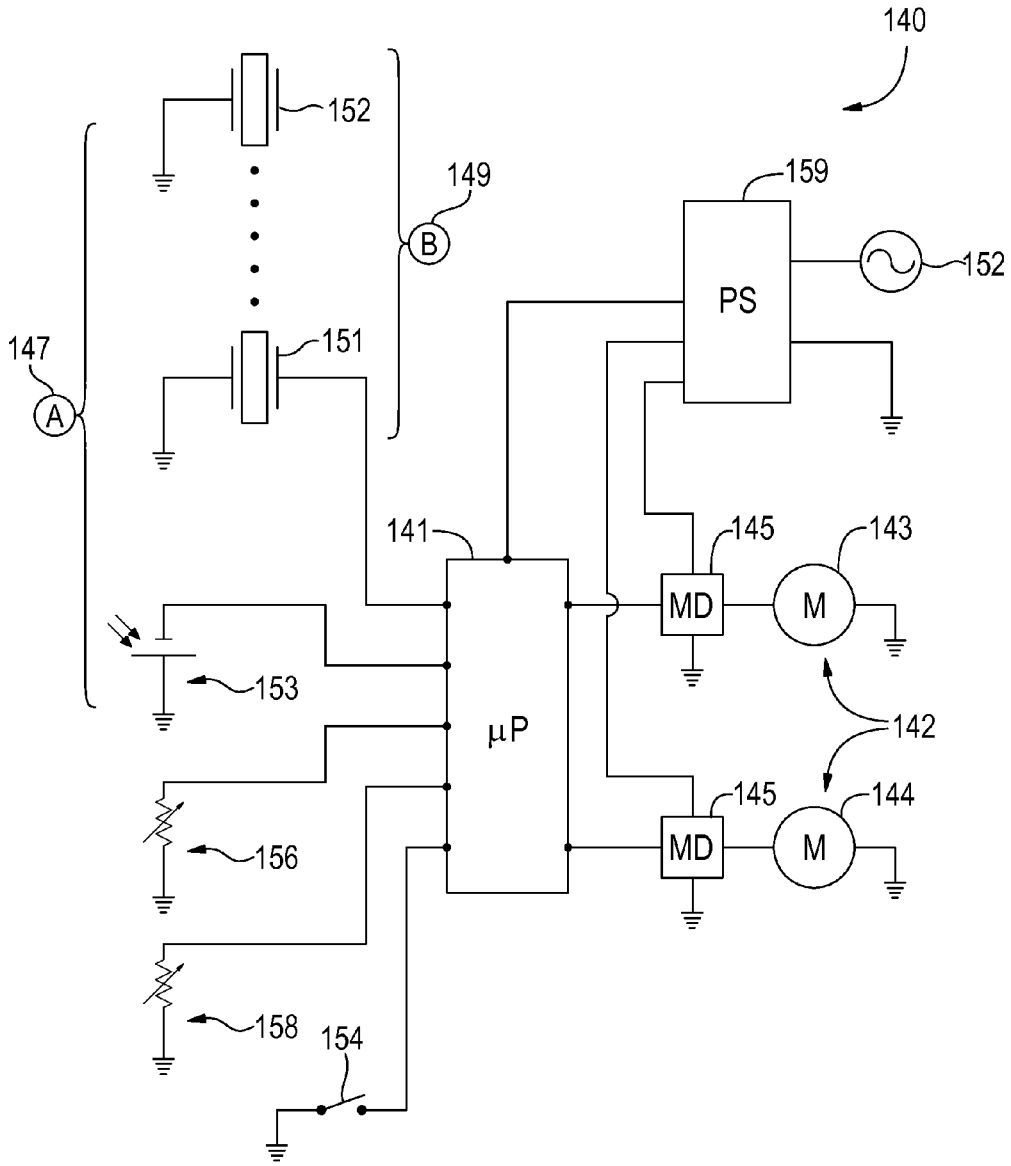
FIG. 9 is an electrical control schematic for the envelope feeder.

As shown in FIG. 9, the control system 140 includes a micro-controller 141 connected to a group A of sensors 147, including the optical proximity sensor 153 for sensing the movement downward of the pickup roller 18, indicating a depletion event in the height of the envelope stack 117, and at least one sensor 151 to indicate a paper out condition in the envelope stack. The micro-controller 141 may be any known 4 or 8 bit micro-controller that can be programmed as is understood in the industry. Additional sensors 152, such as an envelope alignment condition within the pickup zone 116, may also be included to form a second sensor sub-group B 149. Micro-controller 141 also controls motor drivers 145 that turn-on and initiate rotation of two motors 142. Motor 143 drives acceleration feed conveyor 16 and motor 144 drives feed conveyor 17. Two variable resistor elements 156 and 157 control the voltage supplied to the motors 142, and thereby vary the speed of each motor by providing a varying voltage value to the micro-controller 141. Manual switch 154 actuates immediate and continuous movement of the motors 142 pursuant to the loading step 122/123 in FIG. 8, and power supply 159 provides power to the control system 140, including all sensors and motors from an AC source 161.

It will be noted that for the herein described embodiment, feeder 10 does not need the presence of sub-group B 149 sensors to operate. For example, mechanical sensor 151 arranged within the pickup assembly 13 (e.g. element 118 in FIG. 7) may be left unconnected to control system 140 and provide an internal signal to the printer 11 only. Further, sensor group A 147 may be varied as may be understood to enhance the timing and speed of ingestion of envelopes into printer 11. For example, optical proximity sensor 153 might be replaced with a pressure switch adjacent to the stack to determine its height, or by a lever switch in contact with the pickup roller to determine its movement downward. Nevertheless, the inventors prefer the use of an optical proximity sensor to determine a depletion event in the pickup stack 117 at the pickup zone 116 because of its ease of calibration for different types of printers.

Preferably, the micro-controller 141 is programmed to actuate the motors 142 upon the receipt from sensor 153, indicating a stack depletion event, for a time period of approximately one half (½) of one second, although a movement actuation range of 0.3 to 0.7 seconds will typically satisfy the pickup speed for most printers using a pickup roller to ingest an envelope for processing. The duration of the movement actuation should be evaluated prior to feeder 10 operation so that movement duration may be pre-programmed into the micro-controller 141, or a simple variable resistor knob for each roller (e.g. elements 156 and 157) may be adjusted to set the speed of each conveyor drive motor and, thereby, the speed of each conveyor.

The inventors have found that an optimal configuration for the feeder 10 is a speed of 46 inches/minute for the acceleration feed conveyor 16 combined with a speed of 5.7 inches/minute for the feed conveyor 17, thereby yielding an 8:1 speed ratio, with a dual conveyor activation period of 0.5 seconds. However, higher and lower ratios are possible. A low ratio of 5:1 is possible with the acceleration feed conveyor 16 moving at 46 inches/minute and the feed conveyor 17 moving at 9.2 inches/minute, and the conveyors would need to be activated for 0.3 seconds. A high ratio is also possible with the acceleration feed conveyor 16 moving at 46 inches/minute and the feed conveyor 17 moving at 3.8 inches/minute, but the conveyors would need to be activated for at least 0.7 seconds to keep the pickup stack satisfactorily filled. As the ratio decreases, an increase in overlap between envelopes results on acceleration feed conveyor 16 so that a smaller activation period is necessary to replenish the pickup stack for a given conveyor speed. As the ratio increases, the degree of overlap in envelopes on the acceleration feed conveyor 16 decreases such that a longer conveyor activation period is necessary to replenish the pickup stack. However, irrespective of the ratio selected, it is critical that the acceleration feed conveyor 16 must move with sufficient speed to deliver replenishment envelopes to the envelope stack 117 faster than the printer can ingest the envelope pickup stack 117. Further, it is critical that the acceleration feed conveyor 16 be substantially faster than the envelope feed conveyor 17 so that a shingled column is created having a curve similar to the curve 114 shown in FIG. 7. Such a speed differential results in the lying flat or "lying down" of envelopes such that a satisfactory envelope stack 117 is formed within the manual input tray area of printer 11 to allow rapid pickup and ingestion by the pickup roller assembly 13 without stalls.

Figure 10:
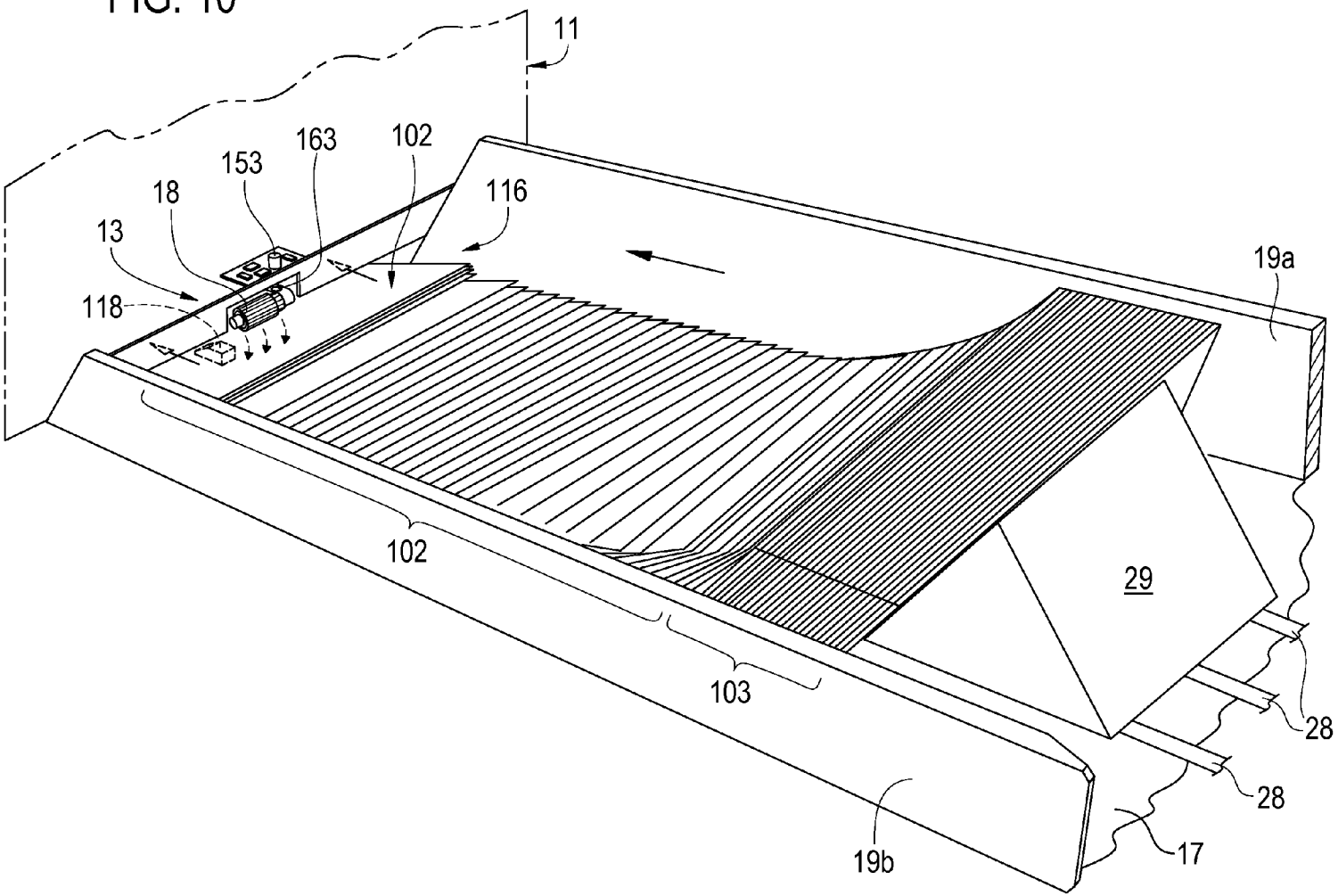
FIG. 10 is magnified view of the envelope feeder connected to a printer and showing one embodiment of an envelope pickup sensor assembly.

FIG. 10 provides a detailed view of the pickup roller assembly 13 with an envelope stack 117 already formed beneath the assembly 13 trailed by a shingled set of waiting envelopes 102. As shown, at the point of pickup of an envelope, roller 18 moves down to capture the top-most envelope and moves it forward into the printer for processing. Other envelopes are stacked in shingled fashion below the lead envelope supporting one another within the pickup zone 116. Paper out sensor 118 is depressed while any envelope is present within the pickup zone 116, thereby stopping the sending of any signal by the sensor 118. Pickup roller 18 includes just below sensor 153 an optically reflective surface 163 capable of reflecting light frequencies detected by sensor 153. When pickup roller 18 moves downward a preselected distance, sensor 153 detects a calibrated loss of reflected light by the sensor due to the distance the reflective surface has moved downward and away from sensor 153. When the pickup roller travels the calibrated distance, sensor 153 sends a signal to the micro-controller 141 as previously discussed and conveyors 16 and 17 activate to replace the envelopes ingested by the printer 11 for a specified time period. Since, optimally, the acceleration conveyor 16 moves at eight (8) times the rate of conveyor 17, a flat shingled procession of envelopes is continually presented to the pickup roller 18 in an orientation that facilitates envelope pickup and at a feed rate that maintains envelopes in the correct orientation in the pickup zone 116 until all envelopes on the acceleration feed conveyor 16 have been exhausted. Guides 19*a* and 19*b* assist to keep the envelope procession structured such that each envelope arrives at the pickup zone 116 with an orthogonally oriented leading edge.

While I have shown my invention in one form, it will be obvious to those skilled in the art that it is not so limited but is susceptible of various changes and modifications without departing from the spirit thereof.

Having set forth the nature of the invention, what is claimed is:

1. In association with a printer having an input slot and a pickup assembly in said input slot, an envelope feeder comprising:

a. a first motorized conveyor having an upstream end and a downstream end, wherein said downstream end is positioned adjacent to an input slot on said printer;

b. a second motorized conveyor having an upstream end and a downstream end, wherein said second conveyor is positioned such that envelopes moved in a downstream direction on said second conveyor empty onto the upstream end of said first conveyor to form a grouping of envelopes thereon;

c. wherein said first conveyor moves at a speed substantially greater than said second conveyor;

d. wherein said feeder is configured to transition a grouping of envelopes on said second conveyor from a substantially vertical orientation in which each envelope on said second conveyor has a horizontally aligned upper edge to a shingled stack of envelopes on said first conveyor, and wherein said shingled stack of envelopes is substantially horizontal upon arrival at said printer;

e. means for providing a backstop to support envelopes loaded on said second conveyor in a substantially vertical position; and, f. control means dependent upon a sensor at said pickup assembly for cooperatively advancing said first and second conveyors responsive to a condition at said input slot.

2. An envelope feeder as recited in claim 1, wherein said feeder is further configured such that the upper edges of said grouping of envelopes on said first conveyor forms a downward sloping curve extending from the downstream end of said second conveyor to the downstream end of said first conveyor.

3. An envelope feeder as recited in claim 2, wherein said speed differential between said first and second conveyors is about seven times greater.

4. An envelope feeder as recited in claim 3, wherein said first and second conveyors define a gap between them comprising a transition zone, and wherein said envelopes transition from a fixed orientation on said second conveyor to a continually rotating orientation on said first conveyor at said transition zone.

5. An envelope feeder as recited in claim 4, wherein said feeder is adapted to form a pickup stack of envelopes within said pickup assembly upon movement of said first conveyor.

6. An envelope feeder as recited in claim 5, further comprising a sensor positioned at said pickup assembly and in electrical communication with said control means, and wherein said sensor is configured to register the depletion of said pickup stack to a predefined level and communicate said depletion event to said control means, and wherein said control means responsive to said depletion event communication is configured to advance said conveyors for a preselected time duration to periodically replenish said pickup stack.

7. An envelope feeder as recited in claim 1, wherein said control means comprises:

a. a micro-controller;

b. a plurality of motor drivers connected to said micro-controller for driving motors on said conveyors;

c. at least one input means connected to said micro-controller for setting the speed of said conveyors;

d. means for supplying power to said control means; and, e. a switch for initiating continuous movement of said conveyors.

8. An envelope feeder as recited in claim 7, wherein said first conveyor comprises:

a. five parallel shafts;

b. a pair of parallel bearing members rotatably supporting said shafts at their ends;

c. two endless conveyor belts spanning said shafts and parallel to one another;

d. drive means connected to one said shaft for driving said same; and, e. at least one guide means for keeping said conveyor belts at fixed locations on said first conveyor.

9. An envelope feeder as recited in claim 8, wherein said second conveyor comprises:

a. two parallel shafts positioned at the ends of said second conveyor;

b. two parallel support plates rotatably supporting said two shafts at their ends;

c. four endless conveyor belts spanning said two shafts;

d. drive means connected to said one shaft at an upstream end of said second conveyor for driving said same;

e. a deck supported by and extending between said two support plates, wherein said conveyor belts are slidably supported by said deck on an upper surface of said second conveyor; and, f. a plurality of rotating guide means affixed to the underside of said deck for tensioning and keeping said conveyor belts at fixed locations on said second conveyor.

10. An envelope feeder as recited in claim 9, wherein said feeder further comprises a base having means for slidably supporting said first and second conveyors, and wherein said first and second conveyors are arranged into a single chassis form.

11. An envelope feeder as recited in claim 10, further comprising two adjustable guide rails extending in an upstream and downstream direction of said feeder for guiding said envelopes along said conveyors during movement thereon.

12. An envelope feeder as recited in claim 1, wherein said feeder is adapted to form a pickup stack of envelopes within said pickup assembly upon movement of said first conveyor, and wherein said feeder further includes a sensor positioned at said pickup assembly and in electrical communication with said control means, and wherein said sensor is configured to register the depletion of said pickup stack to a predefined level and communicate said depletion event to said control means, and wherein said control means responsive to said depletion event communication is configured to advance said conveyors for a preselected time duration to periodically replenish said pickup stack.

13. An envelope feeder as recited in claim 12, wherein said feeder comprises a self-contained movable unit.

14. In association with a printer having a manual input slot for media, a pickup assembly for picking up media placed into said slot, and a paper out sensor positioned in said slot, an envelope feeder for feeding envelopes for printing into said input slot, comprising:

a. a horizontal feeder assembly having an acceleration conveyor positioned adjacent to said manual input slot, a feed conveyor adjacent and in-line with to said acceleration conveyor at the upstream end of said acceleration conveyor, and a pair of parallel guide plates extending along the length of said horizontal feeder assembly on the outside portions of said two conveyors;

b. means for supporting said horizontal feeder assembly in proximal relation to said printer;

c. drive means affixed to each said conveyor for driving said same; and, d. control means responsive to at least one sensor in said manual input slot for advancing said conveyors with said drive means, wherein said control means advances said acceleration conveyor at a rate substantially greater than said feeder conveyor such that envelopes moving on said acceleration conveyor form a downwardly sloping shingled group of envelopes, each envelope having a substantially flat orientation upon reaching said manual input slot.

15. An envelope feeder as recited in claim 14, wherein said acceleration conveyor moves at about seven times the rate of said feed conveyor.

16. An envelope feeder as recited in claim 15, further comprising a backstop supported by said feed conveyor for supporting said envelopes thereon in a substantially vertical orientation.

17. An envelope feeder as recited in claim 16, wherein said feeder comprises a self-contained movable unit.

18. An envelope feeder as recited in claim 14, wherein said sensor is positioned at said pickup assembly and is in electrical communication with said control means.

19. An envelope feeder as recited in claim 18, wherein said conveyors define a gap between them comprising a transition zone, and wherein said envelopes transition from a fixed orientation on said feed conveyor to a continually rotating orientation on said acceleration conveyor at said transition zone.

20. A two stage envelope feeder for feeding envelopes into an input slot on a printer, comprising:

a. a first stage conveyor assembly;

b. a second stage conveyor assembly, wherein said second stage conveyor is positioned to receive envelopes from said first stage conveyor;

c. wherein said first stage conveyor moves envelopes at an identical backward vertical angle of at least 50 degrees and includes means for supporting said envelopes at said angle;

d. control means in communication with said first and second stage conveyors for automatic controlled advancement of envelopes on said conveyors;

e. wherein said control means is adapted to move said second stage conveyor at a speed substantially faster than said first stage conveyor such that envelopes received from said first stage conveyor form a shingled stack having a sloped downward curve and wherein each said envelope arrives at said input slot in a substantially horizontal orientation, and wherein each envelope is vertically stacked upon a previously received envelope within said input slot to create a stacked column of envelopes therein; and, f. an optical sensor positioned proximal to said input slot and in electrical communication with said control means for monitoring the residual height of said vertical envelope stack and sending a signal to said control means upon said vertical envelope stack decreasing to a predetermined residual level.

21. An envelope feeder as recited in claim 20, wherein said first stage conveyor assembly comprises:

a. two parallel shafts positioned at the ends of said first stage conveyor assembly;

b. two parallel support plates rotatably supporting said two shafts at their ends;

c. four endless conveyor belts spanning said two shafts;

d. drive means connected to said one shaft at an upstream end of said first stage conveyor assembly for driving said same;

e. a deck supported by and extending between said two support plates, wherein said conveyor belts are slidably supported by said deck on an upper surface of said first stage conveyor assembly; and, f. a plurality of rotating guide means affixed to the underside of said deck for tensioning and keeping said conveyor belts at fixed locations on said first stage conveyor assembly.

22. A method for feeding envelopes into an input slot of a printer, comprising the steps of:

a. loading envelopes on a first conveyor such that the envelopes are vertically oriented in a stack with a back angle of a predetermined amount;

b. advancing said first conveyor in a downstream direction such that said envelopes empty onto a second conveyor;

c. in cooperative movement between said first and second conveyors, advancing said emptied envelopes on said second conveyor at a speed faster than said first conveyor such that said envelopes form a shingled stack moving in a downstream direction and having their upper edges forming a sloped downward curve, wherein such envelopment movement causes each envelope to arrive at said printer slot in a horizontal orientation;

d. loading a group of said horizontal oriented envelopes into said printer slot to form a pickup stack therein; and, e. automatically advancing said first and second conveyors to replenish said pickup stack as said envelopes are consumed by said printer.

23. The method as recited in claim 22, wherein said step of automatically advancing said first and second conveyors comprises advancing said second conveyor at a rate of between 5 and 12 times the rate of said first conveyor.

24. The method as recited in claim 23, wherein said step of loading a group of said horizontal oriented envelopes into said printer slot comprises loading at least one envelope into said printer slot prior to advancing said first and second conveyors.

25. The method as recited in claim 24, wherein said step of automatically advancing said first and second conveyors to replenish said pickup stack as said envelopes are depleted comprises periodically advancing said conveyors for a predefined time segment of between 0.3 and 0.7 seconds.

26. The method as recited in claim 25, further comprising the step of monitoring said envelope pickup stack with an optical sensor measuring a travel distance of a pickup roller engaging the topmost envelope in said pickup stack and sending a signal to a control means to initiate said automatically advancing replenishment step when said pickup roller travel distance exceeds a specified amount.

27. The method as recited in claim 26, wherein said steps of advancing said first conveyor in a downstream direction with stacked envelopes and advancing emptied envelopes onto said second conveyor to form an envelope stack in said printer slot are controlled by a human operator operating a switch on an electrical control system.

28. The method as recited in claim 22, wherein said step of automatically advancing said first and second conveyors to replenish said pickup stack as said envelopes are depleted comprises periodically advancing said conveyors in predefined time segments.

29. The method as recited in claim 28, wherein said step of automatically advancing said first and second conveyors to replenish said envelope pickup stack further comprises the step of monitoring said envelope pickup stack with an optical sensor measuring a travel distance of a pickup roller engaging the topmost envelope in said pickup stack and sending a signal to a control means to initiate said automatically advancing step.

* * * * *